United States Patent [19]

Wiltgen, Jr.

[11] 4,251,699

[45] Feb. 17, 1981

[54] ARC EXTINGUISHING MATERIAL COMPRISING DICYANDIAMIDE

[75] Inventor: Bernard M. Wiltgen, Jr., Villa Park, Ill.

[73] Assignee: S & C Electric Company, Chicago, Ill.

[21] Appl. No.: 708,548

[22] Filed: Jul. 26, 1976

[51] Int. Cl.[3] ..... H01H 9/32; H01H 33/22

[52] U.S. Cl. ..... 200/144 C; 200/149 A; 252/5; 252/7; 252/571; 169/46

[58] Field of Search ..... 252/63.7; 200/144 C, 200/149 A

[56] References Cited

U.S. PATENT DOCUMENTS

| | | | |
|---|---|---|---|
| 2,328,825 | 9/1943 | McMahon | 200/149 A X |
| 2,526,448 | 10/1950 | Amundson et al. | 200/149 A X |
| 2,722,561 | 11/1955 | McCulloch | 252/63.7 X |
| 2,917,607 | 12/1959 | Sterling | 200/149 A X |
| 3,102,159 | 8/1963 | Ford | 252/63.7 X |
| 3,242,257 | 3/1966 | Jones et al. | 200/144 C X |
| 3,429,819 | 2/1969 | Tierney | 252/63.7 |

FOREIGN PATENT DOCUMENTS 938479 10/1963 United Kingdom .

*Primary Examiner*—Harris A. Pitlick
*Attorney, Agent, or Firm*—John D. Kaufmann

[57] ABSTRACT

An arc quenching composition suitable for deionizing and extinguishing a high voltage electrical arc comprising an effective proportion of dicyandiamide. Depending on the application in which the arc extinguishing composition is employed, the dicyandiamide may be utilized alone, admixed with a suitable binder, or used to impregnate another material.

26 Claims, No Drawings

ARC EXTINGUISHING MATERIAL COMPRISING DICYANDIAMIDE

BACKGROUND OF THE INVENTION

1. Field of the Invention

The present invention relates to arc quenching materials for high voltage electrical devices and equipment wherein under certain conditions of operation a high voltage electrical arc is produced that must be quenched to eliminate an undesirable current flow. More particularly, the present invention relates to the use of dicyandiamide as an arc quenching material in devices such as high voltage fuses, circuit breakers, circuit interrupters, and separable cable connectors.

2. Description of the Prior Art

It is well known in the art that to provide effective circuit interruption it is desirable to utilize an arc quenching material or substance in circuit interrupters and similar devices such as fuses to quench and suppress arcing during contact separation or fuse operation. Typically a trailer-liner configuration is used in circuit interrupters so that the arc is drawn into the annular space between the trailer and liner, each of which may be formed from an arc quenching material. The action of the gases produced by the trailer or liner on the confined arc tends to deionize the arc and force its extinction. In a high voltage fuse typically a sleeve or liner surrounds the path of the arc during fuse operation. Many nonconductive materials are capable of being fabricated into the desired shapes, but the arc quenching current-interrupting effectiveness of such materials varies and many such materials are less effective in providing repeated arc quenching capabilities after initial use. Typically, circuit interrupters have utilized Plexiglas (methyl methacrylate polymer) as a trailer material and Plexiglas, Delrin (polyoxymethylene) or vulcanized fiber as a liner material.

It is well known in the art that in order to perform properly, an arc quenching material should have three important qualities. First, the material should be highly effective in quenching arcs produced over a wide range of electrical operating conditions. The properties of the materials should be such that an arc extinguishing gas is evolved quickly and effectively with a minimum consumption of arc extinguishing material. By minimizing the consumption of the arc quenching material, its operating life is prolonged.

Secondly, the arc quenching material and its solid fused residue should be relatively nonconductive to avoid re-establishing a current flow through the material after interruption.

Finally, the arc quenching material should be capable of being molded or compounded with other materials into a composition having sufficient structural properties for the particular device in which the arc quenching material is employed.

Other properties of the arc quenching material may also be important, such as thermal stability. It is also desirable that the arc quenching gas evolved be neither obnoxious nor toxic.

It has been discovered that dicyandiamide is an effective and suitable arc quenching material.

SUMMARY OF THE INVENTION

The present invention concerns a new and improved arc quenching material comprising an effective proportion of dicyandiamide. The dicyandiamide may be utilized alone, admixed with a suitable binder, or used to impregnate other materials.

Therefore, it is a primary object of the invention to provide effective arc quenching compositions meeting the three primary requirements noted above.

Specifically, it is an object of the invention to provide an arc quenching material which is effective in quickly extinguishing high voltage electrical arcs over a wide range of electrical conditions and with a minimum consumption of the arc quenching material.

Yet another object of the invention is to provide an arc quenching material capable of being formed and compounded into arc quenching compositions having structural properties sufficient for use in a wide variety of devices and applications.

DETAILED DESCRIPTION OF THE PREFERRED EMBODIMENTS

The present invention concerns arc quenching compositions comprising an effective proportion of dicyandiamide. Dicyandiamide, also known as cyanoguanidine, has the following general chemical structure:

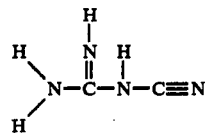

It has now been discovered that dicyandiamide is an effective arc quenching material, i.e., the heat of a high voltage electrical arc causes dicyandiamide to evolve a sufficient amount of deionizing and extinguishing gases that the electrical arc is extinguished rapidly and effectively. The gases evolved consist primarily of ammonia, cyanogen, carbon dioxide and water vapor, but in such quantities as to be neither obnoxious nor toxic.

In some applications, dicyandiamide may be utilized without the addition of other materials. In these instances dicyandiamide may be molded or compressed directly into the form in which it is to be employed in the particular electrical equipment.

In a number of other uses, it may be desirable to employ dicyandiamide with a binder. Suitable binders include thermoplastic and thermosetting organic resins, elastomers, and inorganic binders. Suitable thermoplastic or thermosetting organic resin binders include acrylonitrile butadiene styrene, acetal, acrylic, alkyd, allyl, cellulosic, epoxy, polyallomer, polyethylene, polymethylpentene, polypropylene, polystyrene and polyvinyl chloride resins.

Similarly, the following natural and synthetic elastomeric materials may be useful as binders in arc quenching compositions of this invention: natural rubber, reclaimed rubber, butyl rubber, styrene-butadiene, ethylenepropylene, polyacrylic, nitrile, silicone, fluorocarbon, polyurethane, synthetic polyisoprene, polybutadiene, Neoprenes (polychloroprene), and polysulfide elastomeric. Suitable inorganic binders include portland cement, plaster of paris, clay, ceramics, and water glass.

The foregoing examples are illustrative of suitable materials which may be utilized as binders to provide the requisite structural properties for the particular application in which the dicyandiamide arc quenching composition of the present invention is to be employed. Other materials than those specifically listed may also be employed and the present invention is not limited to the examples listed above.

To further strengthen the arc quenching compositions, it may be desirable to employ additional fibers or fillers. Fibrous materials which may prove useful in particular applications include, among others, asbestos, cellulose, glass, inorganic fibers, and synthetic organic fibers, such as polyacrylonitrile, polyamide, and polyester fibers. Typical fillers include glass, cellulosic materials, calcium carbonate, metal oxides, including alumina, beryllium oxide, magnesia and zinc oxide, comminuted polymers, and natural and synthetic silica materials. These materials are primarily employed to lend desirable structural properties to the arc quenching compositions and to reduce cost. However, in some instances fibrous materials such as those listed may be impregnated with dicyandiamide and utilized in this form without a binder. In addition, the arc quenching compositions may also include small amounts of other materials which have arc extinguishing ability or which enhance the arc extinguishing ability of dicyandiamide. Such materials include, for example, hydrated alumina and boric acid.

The arc quenching compositions of the present invention typically include from 5.0 to 100.0 percent by weight of dicyandiamide and preferably from 10 to 70 percent by weight dicyandiamide. The minimum amount of dicyandiamide which is effective in any composition and the most effective percentage of dicyandiamide employed in any specific composition depends on the nature of the binder, fillers, and other effective arc quenching materials which are utilized. The minimum and most effective proportions of dicyandiamide for particular circuit interrupting capabilities are primarily determined by empirical methods.

Numerous methods known in the art may be employed to incorporate dicyandiamide into arc quenching compositions in which a fibrous support material or a binder is employed. For example, an aqueous solution of dicyandiamide can be prepared and the solution used to impregnate the binder or fibrous material preformed in the appropriate part of the electrical apparatus. The absorption of dicyandiamide from the solution can be facilitated by applying a vacuum. Alternatively, the solution can be used to impregnate fibrous material which is then incorporated into the binder. Another alternative is to mill the dicyandiamide and binder in a plastics mill and then transfer mold or extrude the mixture into the appropriate shape. Other suitable methods known in the art can be utilized to prepare the dicyandiamide arc quenching compositions of this invention.

Some typical dicyandiamide containing arc quenching compositions which may be employed include the following:

| Composition | Ingredients |
|---|---|
| A | dicyandiamide<br>(no additional materials) |
| B | dicyandiamide - 100 parts by weight<br>polyethylene - 50 parts |
| C | dicyandiamide - 20 parts<br>nylon paper - 80 parts |
| D | dicyandiamide - 100 parts<br>polypropylene - 50 parts |

EXPERIMENTAL EVALUATIONS

The following tests were conducted to illustrate the effectiveness of dicyandiamide as an arc quenching composition.

Evaluation 1

In this invention, arc interrupting compositions of the present invention were prepared and tested in a loadbreak device as described and illustrated as element 55 in U.S. Pat. No. 2,351,826 to Lindell et al. which is assigned to the assignee of the present invention. The composition utilized consisted of two-thirds by weight dicyandiamide to one-third polypropylene ("2:1 D/PP") corresponding to composition D above. The dicyandiamide and polypropylene were compounded in a two-roll plastics mill and then transfer molded into liners (bore 65 of the device shown in the referenced patent) and trailers (75). Rather than using a stack of rings as shown in the referenced patent, the liners were molded in a one piece cylindrical form. The liners were approximately 3.4 inches long with outside and inside diameters of 0.87 inches and 0.63 inches, respectively. The trailers were molded on glass-polyester rods and were approximately 3.6 inches long and 0.60 inches in diameter. The liners and trailers were then installed in the loadbreak device and tested at a number of operating conditions as shown in Table I. The average time needed to quench the arc was determined and is reported in Table I. These results are compared to the results of similar tests performed on an arc extinguishing material consisting of three-fourths by weight melamine and one-fourth polyethylene ("STD-1"). Test 1 tested the arcing time under load circuit conditions. Tests 2–6 evaluated the materials under fault switching conditions. The severity of tests 2–6 was increased by increasing the natural frequency of the transient recovery voltage. Testing of each material was continued until failure occurred or the limit of the test equipment was reached.

For the purposes of this test evaluation and the following test evaluations, it should be understood that the following terms have the following commonly well known definitions.

The "recovery voltage" refers to the 60 cycle voltage that appears across the switching device after interrupting the circuit. Recovery voltage is normally the open circuit voltage and the recovery voltage does not contain any transient components.

The "transient recovery voltage" is the voltage that appears across a switch or loadbreak device during the time when the switch goes from a current conducting state, i.e., when the voltage across the switch is nominally zero, to the time when the voltage is the 60 cycle recovery voltage described above. During fault switching, this transient recovery voltage oscillates at a usually high frequency and this frequency is called the "transient recovery voltage frequency." This oscillatory transient voltage overshoots the crest of the recovery voltage and can have a maximum value of twice the nominal recovery voltage.

The "power factor" is a measure of the reactive nature of the test circuit. For the purposes of these test evaluations, the smaller the power factor, the more severe is the peak of the transient recovery voltage, and consequently the test circuit is more severe.

TABLE I

| | ELECTRICAL CONDITIONS | | | | RESULTS | | | |
|---|---|---|---|---|---|---|---|---|
| | Recovery Voltage (kV) | Amperes (rms) | Power Factor | Transient Recovery Voltage Frequency (kHz) | No. of Operations 2:1 D/PP | No. of Operations STD | Time (milliseconds) 2:1 D/PP | Time (milliseconds) STD-1 |
| | 15.2 | 600 | 1 | — | 5 | 5 | 11.4 | 10.1 |
| TEST 1 | 25 | 600 | 1 | — | 5 | 5 | 13.7 | 12.0 |
| | 24 | 900 | 1 | — | 5 | 5 | 11.3 | 14.6 |
| | 9 | 93 | .3 | 5 | 6 | 5 | 9.8* | 12.7 |
| | 9 | 600 | .3 | 5 | 5 | 5 | 10.3 | 11.4 |
| | 15.5 | 87 | .3 | 3.6 | 5 | 2 | 15.3 | **** |
| TEST 2 | 15.5 | 87 | .3 | 8.7 | 5 | 0*** | 23.5 | —*** |
| | 15.5 | 87 | .3 | 13.3 | 5 | 0 | 25.2 | — |
| | 15.5 | 590 | .34 | 4.3 | 3 | 3 | 13.0 | 9.3 |
| | 15.5 | 590 | .34 | 8.6 | 3 | 3 | 10.5 | 14.2 |
| TEST 3 | 15.5 | 590 | .34 | 11.3 | 3 | 3 | 12.0 | 14.3 |
| | 15.5 | 590 | .34 | 14.6 | 3 | 3 | 20.5 | 20.0 |
| | 15.5 | 590 | .34 | 18.2 | 1 | 3 | F** | F |
| TEST 4 | 27 | 100 | .3 | 4.5 | 2 | 1 | F | F |
| | 15 | 1200 | .3 | 5 | 3 | 3 | 14.0 | 13.0 |
| TEST 5 | 15 | 1200 | .3 | 9.3 | 3 | 3 | 13.5 | 12.0 |
| | 15 | 1200 | .3 | 14.3 | 3 | 3 | 14.0 | 18.3 |
| TEST 6 | 14 | 2000 | .3 | 8.3 | 1 | 0 | F | — |

*One sample exhibited an external flashover caused by extraneous gas flow along the insulator surrounding the sleeve but this factor is not a measure of the effectiveness as an arc extinguishing material.
**F - the arc was not extinguished at the indicated conditions.
***Test was discontinued following a failure.
****Both samples exhibited external flashover caused by extraneous gas flow along the insulator surrounding the sleeve.

The data in Table I illustrates the ability of dicyandiamide to rapidly extinguish electrical arcs produced over a variety of electrical conditions.

It should be noted that the two to one composition of dicyandiamide and polypropylene ("2:1 D/PP") material demonstrated arc quenching times comparable to those of the STD-1 material. In addition, the 2:1 D/PP material demonstrated effectiveness in extinguishing arcs at more extreme conditions than the STD-1 material.

Evaluation 2

Utilizing the same equipment, test procedures, and test conditions as in Evaluation 1, additional tests were performed on an arc quenching composition consisting of two-thirds by weight dicyandiamide and one-third polyethylene ("2:1 D/PE"). Liners and trailers of this composition were prepared in the same manner as the dicyandiamide arc quenching compositions of Evaluation 1. The liners and trailers were then installed in the loadbreak device and tested at a number of operating conditions as shown in Table II. The average time needed to quench the arc was determined and is also reported in Table II. These results are compared to the result of similar tests performed on a standard arc extinguishing material ("STD-2") comprising a trailer fabricated of Plexiglass and a liner fabricated of Delrin. The average time needed to quench an arc produced at a number of operating conditions was determined and is reported in Table II.

The results reported in Table II indicate that the two to one composition of dicyandiamide and polyethylene ("2:1 D/PE") material demonstrated substantially shorter arcing times under load conditions than the standard ("STD-2") material. Further, under fault switching conditions, the 2:1 D/PE material not only demonstrated shorter arcing times, but also demonstrated effectiveness in extinguishing arcs at more extreme conditions than the standard material.

TABLE II

| | ELECTRICAL CONDITIONS | | | | RESULTS | | | |
|---|---|---|---|---|---|---|---|---|
| | Recovery Voltage (kV) | Amperes (rms) | Power Factor | Transient Recovery Voltage Frequency (kHz) | No. of Operations 2:1 D/PE | No. of Operations STD | Time (milliseconds) 2:1 D/PE | Time (milliseconds) STD-2 |
| TEST 1 | 15.2 | 600 | 1 | — | 5 | 5 | 6.8 | 13.5 |
| | 25 | 600 | 1 | — | 5 | 5 | 16.1 | 29.1 |
| | 24 | 900 | 1 | — | 5 | 6 | 17.9 | 31.3 |
| TEST 2 | 9 | 93 | .3 | 5 | 6 | 5 | 11.3* | 16.1 |
| | 9 | 600 | .3 | 5 | 5 | 5 | 9.5 | 15.4 |
| | 15.5 | 87 | .3 | 3.6 | 4 | 5 | F | 22.4 |
| | 15.5 | 87 | .3 | 8.7 | 0*** | 2 | —*** | F |
| | 15.5 | 87 | .3 | 13.3 | 0 | 0 | — | — |
| TEST 3 | 15.5 | 590 | .34 | 4.3 | 3 | 3 | 12.2 | 17.3 |
| | 15.5 | 590 | .34 | 8.6 | 3 | 3 | 13.2 | 16.5 |
| | 15.5 | 590 | .34 | 11.3 | 3 | 2 | 14.2 | F |

TABLE II-continued

| | ELECTRICAL CONDITIONS | | | | RESULTS | | | |
|---|---|---|---|---|---|---|---|---|
| | Recovery Voltage (kV) | Amperes (rms) | Power Factor | Transient Recovery Voltage Frequency (kHz) | No. of Operations 2:1 D/PE | No. of Operations STD | Time (milliseconds) 2:1 D/PE | Time (milliseconds) STD-2 |
| | 15.5 | 590 | .34 | 14.6 | 3 | 0 | 17.3 | — |
| | 15.5 | 590 | .34 | 18.2 | 3 | 0 | 75.0 | — |
| TEST 4 | 27 | 100 | .3 | 4.5 | 1 | 1 | F | F |
| TEST 5 | 15 | 1200 | .3 | 5 | 3 | 3 | 13.8 | 14.2 |
| | 15 | 1200 | .3 | 9.3 | 3 | 1 | 13.5 | F |
| | 15 | 1200 | .3 | 14.3 | 3 | 0 | 22.2 | — |
| TEST 6 | 14 | 2000 | .3 | 8.3 | 1 | 2 | F | F |

*One sample exhibited an external flashover caused by extraneous gas flow along the insulator surrounding the sleeve but this factor is not a measure of the effectiveness as an arc extinguishing material.
**F - the arc was not extinguished at the indicated conditions.
***Test was discontinued following a failure.

Evaluation 3

In this evaluation, arc quenching compositions were utilized in a high voltage fuse. Typically such devices contain an inner sleeve surrounding the path of the arc which is produced when the fuse operates. In the present example sleeves of several different materials were impregnated with an aqueous solution of dicyandiamide under vacuum. The sleeves were then dried. Comparative weighing revealed that the sleeves had absorbed between 5 and 35 percent by weight dicyandiamide. The sleeves were then tested under various electrical conditions selected to simulate as closely as possible secondary fault conditions on transformers and the results are reported in Table III. The specifications for the various samples listed in Table III are given in Table IV. Samples C-1 through C-4 utilized nylon paper and samples C-5 through C-8 utilized cellulose paper. The tests were also conducted on standard ("STD-3") commercially available fuse link sleeves for comparison purposes, and the results of these tests are also reported in Table III.

TABLE III

| | Test Conditions*** | | | | | | | |
|---|---|---|---|---|---|---|---|---|
| | 27 kV 9 kHz | 50 amp .80 PF | 27 kV 14 kHz | 100 amp .55 PF | 27 kV 20 kHz | 200 amp .45 PF | 27 kV 18 kHz | 400 amp .20 PF |
| Sample | Clear* | Fail** | Clear | Fail | Clear | Fail | Clear | Fail |
| STD-3 | 10 | 0 | 0 | 10 | 0 | 10 | 5 | 5 |
| C-1 | 3 | 0 | 4 | 1 | 1 | 2 | 3 | 0 |
| C-2 | 3 | 0 | 3 | 0 | 1 | 2 | 0 | 3 |
| C-3 | 3 | 0 | 4 | 1 | 3 | 0 | 2 | 1 |
| C-4 | 3 | 0 | 2 | 1 | 3 | 0 | 0 | 3 |
| C-5 | 1 | 1 | 3 | 0 | 1 | 2 | 0 | 3 |
| C-6 | — | — | 2 | 1 | 2 | 1 | 2 | 1 |
| C-7 | 0 | 3 | 1 | 2 | 3 | 0 | 1 | 2 |
| C-8 | — | — | 3 | 0 | 1 | 2 | 3 | 0 |

*Number of tests in which arc was successfully extinguished.
**Number of tests in which arc was not extinguished.
***Recovery voltage (kV), current (amp), transient recovery voltage frequency (kHz), and power factor (PF).

TABLE IV

| Sample | I.D. (in.) | Thickness (in.) | Length (in.) |
|---|---|---|---|
| C-1 | .210 | .03-.04 | 5 ⅝ |
| C-2 | .210 | .03-.04 | 8 ½ |
| C-3 | .260 | .03-.04 | 5 ⅝ |
| C-4 | .260 | .03-.04 | 8 ½ |
| C-5 | .210 | .03-.04 | 5 ⅝ |
| C-6 | .210 | .03-.04 | 8 ½ |
| C-7 | .260 | .03-.04 | 5 ⅝ |

TABLE IV-continued

| Sample | I.D. (in.) | Thickness (in.) | Length (in.) |
|---|---|---|---|
| C-8 | .260 | .03-.04 | 8 ½ |

The data in Tables III and IV again illustrate the effectiveness of dicyandiamide as an arc quenching material, in this instance in the form of impregnated paper rather than in conjunction with a binder. It should be noted that at the 100 and 200 amp range, the various test samples demonstrated marked superiority over the standard commercially available sleeves.

I claim:

1. An arc quenching composition comprising:
an amount of dicyandiamide effective for arc quenching, and
an elastomeric binder.

2. An arc quenching composition comprising:
an amount of dicyandiamide effective for arc quenching, and
an inorganic binder.

3. An arc quenching composition comprising:
an amount of dicyandiamide effective for arc quenching, said dicyandiamide being in the form of a compressed cake.

4. An arc quenching composition comprising:
an amount of dicyandiamide effective for arc quenching, and
a polyethylene or polypropylene binder.

5. A method for quenching an electrical arc consisting of positioning an arc quenching composition comprising an amount of dicyandiamide effective for arc quenching sufficiently near the arc so that the heat of the arc causes a sufficient quantity of deionizing and extinguishing gas to be emitted from the composition and effectively terminate the arc.

6. The method of claim 5 wherein dicyandiamide comprises at least 5 percent by weight of the total arc quenching composition.

7. The method of claim 5 wherein the arc quenching composition also includes a thermoplastic binder.

8. The method of claim 5 wherein the arc quenching composition also includes a thermosetting binder.

9. The method of claim 5 wherein the arc quenching composition also includes an elastemeric binder.

10. The method of claim 5 wherein said arc quenching composition also includes an inorganic binder.

11. The method of claim 5 wherein said dicyandiamide is impregnated in a fibrous material.

12. The method of claim 5 wherein said dicyandiamide is in the form of a compressed cake.

13. The method of claim 5 wherein said arc quenching composition includes a binder comprising polyethylene.

14. The method of claim 5 wherein said arc quenching composition includes a binder comprising polypropylene.

15. The method of claim 5 wherein dicyandiamide comprises from 10 to 70 percent by weight of the total arc quenching composition.

16. A method of rendering a structure capable of extinguishing an electrical arc in proximity thereto, comprising the step of including in said structure an amount of dicyandiamide effective for arc quenching.

17. The method of claim 16 wherein dicyandiamide comprises at least 5 percent by weight of the structure.

18. The method of claim 17 wherein the structure also includes a thermoplastic binder.

19. The method of claim 17 wherein the structure also includes a thermosetting binder.

20. The method of claim 17 wherein the structure also includes an elastomeric binder.

21. The method of claim 17 wherein the structure also includes an inorganic binder.

22. The method of claim 17 wherein said dicyandiamide is impregnated in a fibrous material.

23. The method of claim 17 wherein said dicyandiamide is in the form of a compressed cake.

24. The method of claim 17 wherein the structure includes a binder comprising polyethylene.

25. The method of claim 17 wherein the structure includes a binder comprising polypropylene.

26. The method of claim 16 wherein dicyandiamide comprises from 10 to 70 percent by weight of the total structure.

* * * * *